United States Patent [19]

Harvey

[11] 4,049,226

[45] Sept. 20, 1977

[54] HORIZONTAL SHELF AND VERTICAL PANEL BRACKET

[76] Inventor: Louis A. Harvey, 15107 Ilene St., Detroit, Mich. 48238

[21] Appl. No.: 684,538

[22] Filed: May 10, 1976

[51] Int. Cl.[2] ..... A47G 29/02

[52] U.S. Cl. ..... 248/248; 248/475 R

[58] Field of Search ..... 108/152; 211/90; 248/235, 240, 247–250, 300, 301, 475 R, 488

[56] References Cited

U.S. PATENT DOCUMENTS

| | | | |
|---|---|---|---|
| 1,940,157 | 12/1933 | Tucker | 248/300 X |
| 2,498,623 | 2/1950 | Poupitch | 248/235 |

FOREIGN PATENT DOCUMENTS

| | | | |
|---|---|---|---|
| 543,318 | 9/1922 | France | 248/248 |
| 442,787 | 4/1927 | Germany | 248/250 |
| 294,652 | 3/1932 | Italy | 248/488 |
| 303,004 | 11/1932 | Italy | 248/235 |
| 129,840 | 1/1929 | Switzerland | 248/235 |
| 635,323 | 4/1950 | United Kingdom | 248/475 R |

*Primary Examiner*—Lawrence J. Staab
*Attorney, Agent, or Firm*—Willis Bugbee

[57] ABSTRACT

An elongated mounting plate has shelf-supporting arms extending outward therefrom in spaced parallel relationship from the opposite ends thereof. These arms at their junctions with the bridge portion have notches for the reception of interchangeable vertical ornamental panels, whereas these arms have elongated recessed portions in their upper edges extending back to the upper ends of the notches for the reception of a horizontal shelf panel.

1 Claim, 6 Drawing Figures

FIG. 1
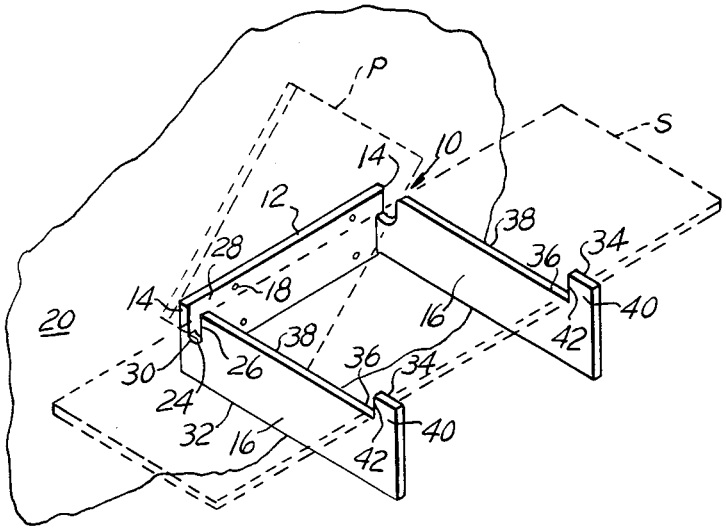
FIG. 3
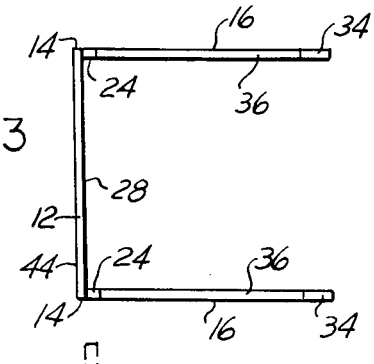
FIG. 2
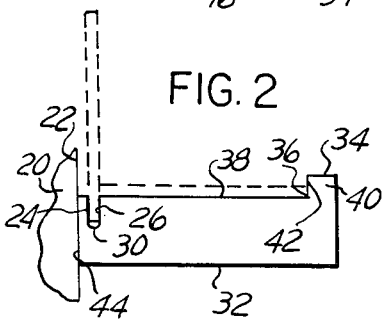
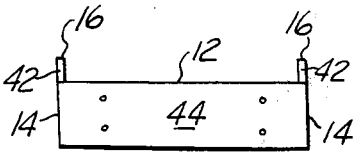
FIG. 5
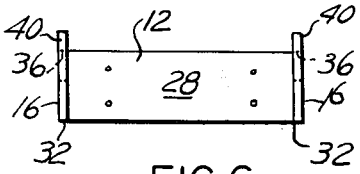
FIG. 6
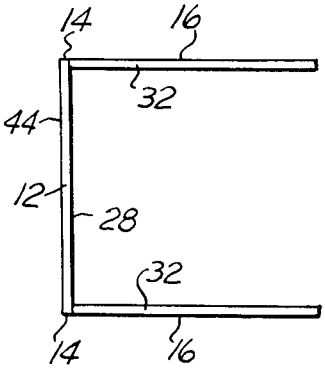
FIG. 4

HORIZONTAL SHELF AND VERTICAL PANEL BRACKET

SUMMARY OF THE INVENTION

The invention particularly resides in the notches at the inner ends of the shelf-supporting arms projecting outward from the mounting plate and in the elongated shelf-receiving recesses in the upper edges of the arms extending backward to these notches. In the drawing, FIG. 1 is a perspective view, from above, of a horizontal shelf and vertical panel bracket in use, according to the invention, with the horizontal shelf and vertical ornamental panel shown in dotted lines;

FIG. 2 is a side elevation of the bracket shown in FIG. 1;

FIG. 3 is a top plan view of the bracket shown in FIG. 1;

FIG. 4 is a bottom plan view of the bracket shown in FIGS. 2 and 3;

FIG. 5 is a rear elevation of the bracket shown in FIGS. 2, 3, and 4; and

FIG. 6 is a front elevation of the bracket shown in FIGS. 2 to 5 inclusive.

Referring to the drawing in detail, FIG. 1 shows a shelf and ornamental panel-supporting bracket, generally designated 10, according to a preferred form of the invention, as consisting generally of a mounting plate 12 which serves as a bridge portion connecting the opposite ends 14 thereof to shelf-supporting arms 16 extending outward therefrom in spaced parallel relationship. The mounting plate 12 is preferably provided with holes 18 for reception of fasteners (not shown) adapted to extend into a wall 20 (FIG. 2) and hold the mounting plate 12 securely against the wall 20 (FIG. 2) and hold the mounting plate 12 securely against the wall surface 22. The arms 16 at their junctions with the opposite ends 14 of the mounting plate 12 are provided with elongated vertical panel-receiving notches 24 having forward edges 26 disposed parallel to the front surface 28. The bottoms 30 of the notches 24 are spaced above the lower edges 32 of the arms 16. Each arm 16 rearward of its upper edge 34 is provided with an elongated recess 36, the upper edge 38 of which is elongated and extends back to the forward edge 26 of its respective notch 24. The outer upper end portions 40 of the arms 16 forward of the recesses 36 serve as stops adapted for the retention of a shelf S in the form of a panel resting upon the lower edges 38 of the recess 36 against the forward vertical edges 42 thereof, whereas its rearward edges are adapted to rest against an ornamental panel P, such as a picture or mirror, which is inserted edgewise into the notches 24 and against the front surface 28 of the bridge portion or mounting plate 12 of the bracket 10.

In the use of the shelf and ornamental panel-supporting bracket 10, the bridge portion or mounting plate 12 is secured in any desired location to the surface 22 of the wall 20 (FIG. 2) by means of fasteners (not shown) inserted therein through the holes 18 in the bridge portion or mounting plate 12. Optionally, the holes 18 may be ommitted and the bridge portion or mounting plate 12 secured by an adhesive between the front surface of the wall 20 and the rear surface 44 of the attachment or bridge portion 12. Any ornamental panel P, such as a picture, tile, mirror of the like is then inserted in the notches 24 in a vertical position against the front edges 26 of the notches 24 and the front surface 28 of the bridge portion 12, as shown by the upright dotted lines in FIG. 1. A suitable horizontal shelf panel S is then inserted in the recesses 36 against the vertical edges 42 of the stop portions 40 at the front and against the panel P at the rear. Any desired ornamental object, such as flowers, figurines, or the like, may then be placed on the shelf S. The ornamental panel P may be easily removed and a mirror or other ornamental panel substituted from time to time to enhance or vary the decoration of the room in which the shelf bracket 10 is located. The changing of panel P and shelf S to other materials, designs, or shapes is thus accomplished quickly and easily without the need for any tools.

I claim:

1. A supporting bracket for horizontal shelves and vertical panels, comprising a substantially U-shaped one-piece bracket structure consisting of a single strip of sheet material including a horizontally-elongated bridge portion adapted to be secured to an upright supporting structure, and a pair of elongated arm portions extending perpendicularly outward in laterally-spaced parallel relationship from the opposite ends of said bridge portion, each arm adjacent its junction with said bridge portion having a downwardly-extending vertical panel-receiving notch therein, each arm also having an elongated horizontal shelf-receiving recess in the upper edge thereof extending horizontally outward therealong remote from its respective notch and having a length a multiplicity of times the width of its respective notch, each arm near its outer end having an upstanding stop portion therein disposed remote from its respective notch, and each recess terminating at its outer end at its respective stop portion.

* * * * *